US005649600A

United States Patent [19]

Marsh

[11] Patent Number: 5,649,600

[45] Date of Patent: Jul. 22, 1997

[54] SENSOR MOUNT FOR AN EXCAVATOR

[75] Inventor: Richard G. Marsh, Simi Valley, Calif.

[73] Assignee: Asahi Precision Co., Ltd., Tokyo, Japan

[21] Appl. No.: 585,160

[22] Filed: Jan. 11, 1996

[51] Int. Cl.[6] ..... E02F 5/02

[52] U.S. Cl. ..... 172/4.5; 37/DIG. 19; 414/698

[58] Field of Search ..... 33/333, 370, 371; 37/348, 347, 901, 903; 172/3, 4, 4.5, 7, 9, 11; 414/698

[56] References Cited

U.S. PATENT DOCUMENTS

| | | | |
|---|---|---|---|
| 3,763,570 | 10/1973 | Andersen | 33/333 X |
| 4,231,700 | 11/1980 | Studebaker . | |
| 4,282,413 | 8/1981 | Simons et al. | 200/81.9 M |
| 4,393,606 | 7/1983 | Warnecke . | |
| 4,726,682 | 2/1988 | Harms et al. . | |
| 4,743,893 | 5/1988 | Gentile et al. | 340/685 |
| 4,829,418 | 5/1989 | Nielson et al. . | |
| 4,884,939 | 12/1989 | Nielsen | 414/698 |
| 4,888,890 | 12/1989 | Studebaker et al. . | |
| 4,923,015 | 5/1990 | Barsby et al. | 172/4.5 |
| 4,944,103 | 7/1990 | Rzechula . | |
| 5,063,679 | 11/1991 | Schwandt | 33/370 X |
| 5,095,629 | 3/1992 | Klemer et al. . | |

OTHER PUBLICATIONS

Easy–Grade Receiver Model RD1 Brochure From Spectra–Physics Laserplane, Inc. of Dayton, Ohio.

*Primary Examiner*—Terry Lee Melius
*Assistant Examiner*—Robert Pezzuto
*Attorney, Agent, or Firm*—Greenblum & Bernstein, P.L.C.

[57] ABSTRACT

A laser receiving depth sensor is attached to the stick of an excavator or backhoe. A mounting bar is magnetically mounted to the stick and the sensor is adjustably slidable along said mounting bar when fixed at selected one of a plurality of positions along the mounting bar.

16 Claims, 6 Drawing Sheets

SENSOR MOUNT FOR AN EXCAVATOR

BACKGROUND OF THE INVENTION

1. Field of the Invention

The present invention relates to a laser sensor for sensing the depth of an excavation, which is easily attached and detached from a stick of an excavator or backhoe.

2. Description of Relevant Materials

It has been known to mount the laser receiver or sensor to the stick of an excavator to determine the depth of the cutting edge of the digging bucket with respect to a known elevation. An example of such arrangement is disclosed in NIELSEN, U.S. Pat. No. 4,884,939, the disclosure of which is herein incorporated by reference in its entirety.

The known laser receiver or sensor mounts are disadvantageous because the sensor must be fixedly attached to the stick of the excavator or, as shown in NIELSEN, a complicated mounting arrangement is fixedly attached to such stick. That is, the excavators must be modified for the sensor to be attached thereto.

SUMMARY OF THE INVENTION

The present invention overcomes the disadvantages discussed above by providing an easily attached sensor to the stick of an excavator. This attachment arrangement is light, lower in cost, and can be attached to any excavator. Also, it is easy to change the sensor from one excavator to a different excavator.

The above object is attained by providing a magnetic mounting arrangement in which magnets are attached to a mounting bar and such mounting bar is adjustably attached to the stick of an excavator. An intermediate dovetail assembly is mounted to the mounting bar and the sensor is attached to the dovetail assembly by a screw or bolt having a knurled knob.

By this arrangement, the mounting bar can be attached at any position along the stick and the sensor may be adjustably mounted at different locations along the mounting bar. In this manner, the sensor is easily and adjustably attached to a stick of any excavator or backhoe without having to modify the stick.

According to one aspect of the invention, a depth sensor is attached to the stick of an excavator and includes a sensor for sensing a laser beam, a mounting device for mounting the sensor to the stick of an excavator, and at least one magnet for attachment to the stick.

The mounting device may include a mounting bar attached to the at least one magnet, an assembly being slidably mounted along the mounting bar, and the sensor being attached to the assembly. The assembly may include a groove which is complimentary in shape to the shape of the mounting bar, and the mounting bar is received in the groove. The groove may be substantially trapezoidally shaped.

According to another aspect of the invention, a bar is mounted on the opposite side of the sensor from the assembly, and a first threaded element extends through the bar, the depth sensor, and the assembly. The mounting bar may include a plurality of holes, and the first threaded element extends into a selected one of the plurality of holes. At least one second threaded extends through the assembly, the sensor, and into the bar.

The first threaded element may include a knob and the mounting device may include a plurality of magnets. The mounting bar has first and second ends and a magnet is attached adjacent to each of the first and second ends.

BRIEF DESCRIPTION OF THE DRAWINGS

The invention is further explained in the description which follows with reference to the drawings, illustrating by way of non-limiting examples, embodiments of the invention therein.

DETAILED DESCRIPTION OF THE PREFERRED EMBODIMENTS

Figure 1:
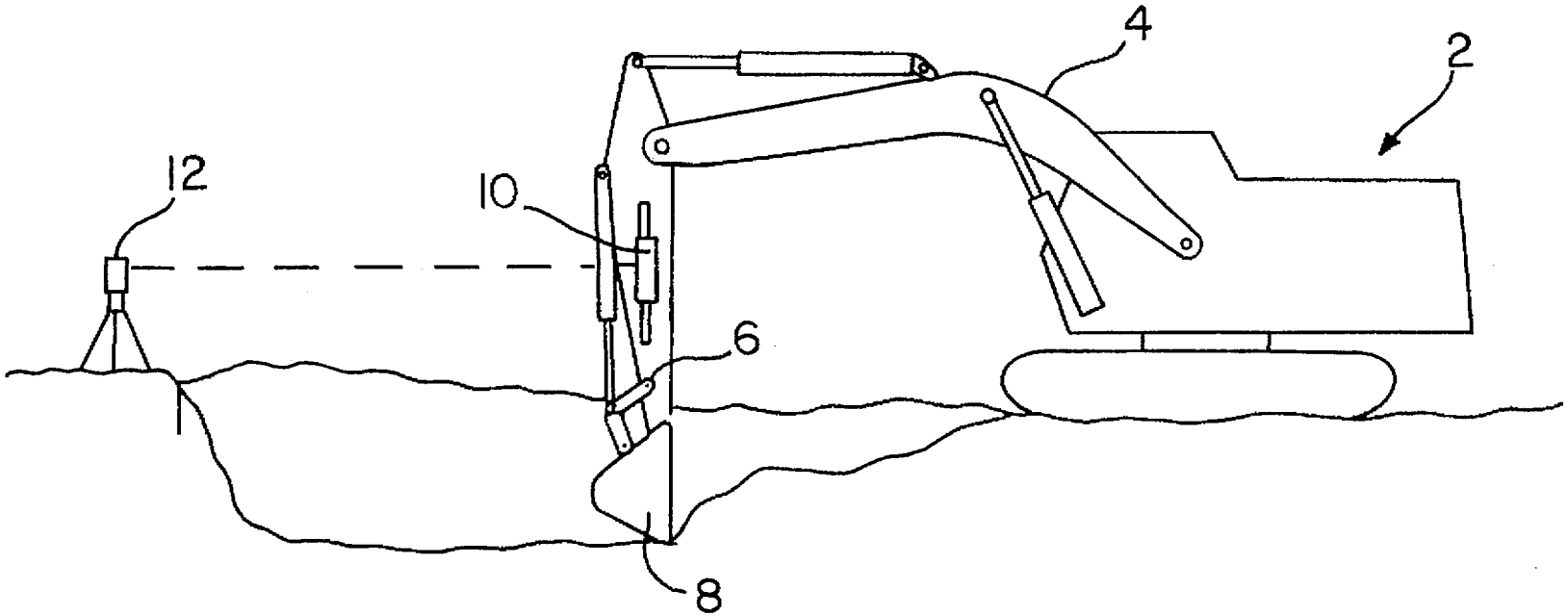
FIG. 1 is a side view of the depth sensor attached to the stick of an excavator.
Figure 2:
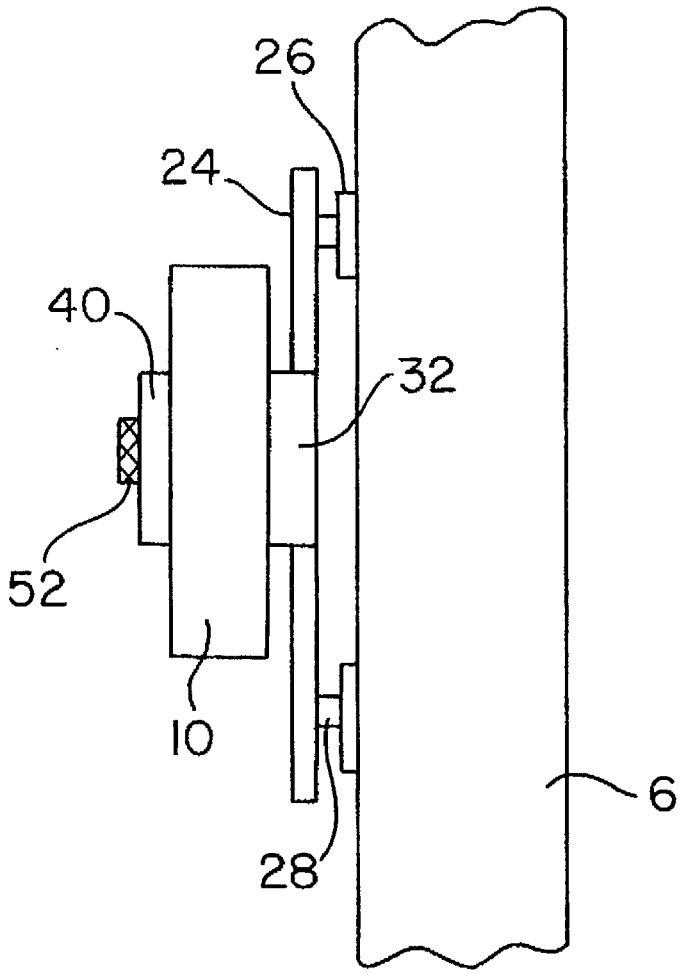
FIG. 2 is an enlarged end view of the attachment assembly.

Referring to FIG. 1, a conventional excavator 2 includes a boom 4, a stick 6, and a digging bucket 8, which are all movable relative to each other by conventional actuators, such as hydraulic cylinders.

Depth sensor or receiver 10 is adjustably attached to stick 6 and receives a laser beam from remote laser source 12.

By knowing the elevation of laser source 12, depth sensor 10 will be adjusted from the cutting edge of bucket 8 to obtain the finished grade which is at a desired depth. This known operation is discussed in U.S. Pat. No. 4,884,939.

Figure 4:
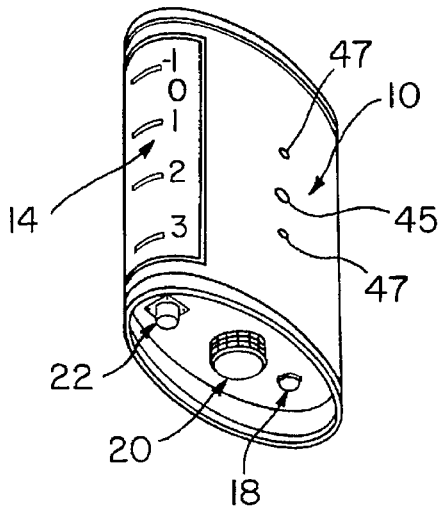
FIG. 4 is a reverse view of the sensor with respect to FIG. 3.
Figure 3:
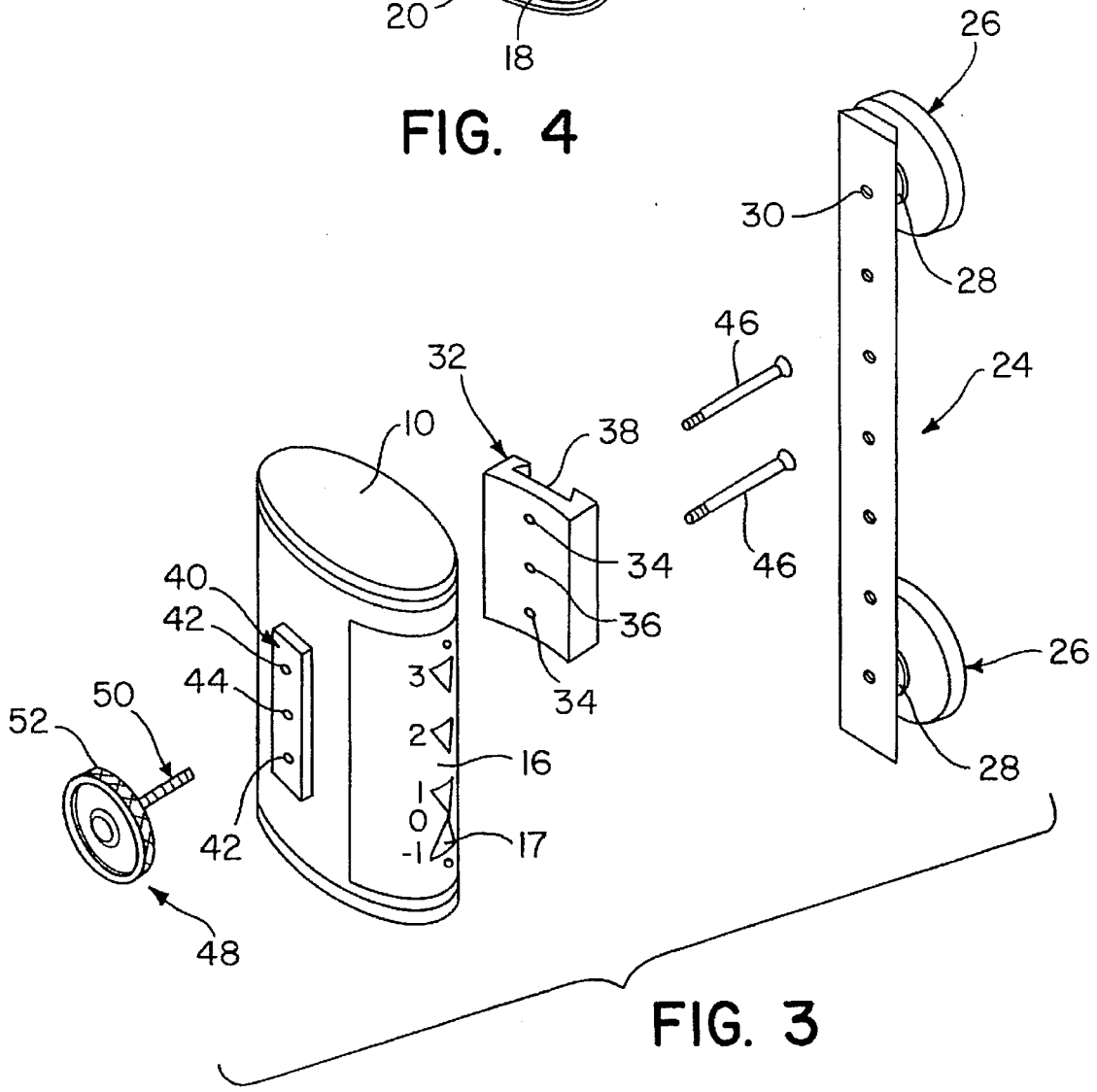
FIG. 3 is an exploded view of the attachment assembly.
Figure 5:
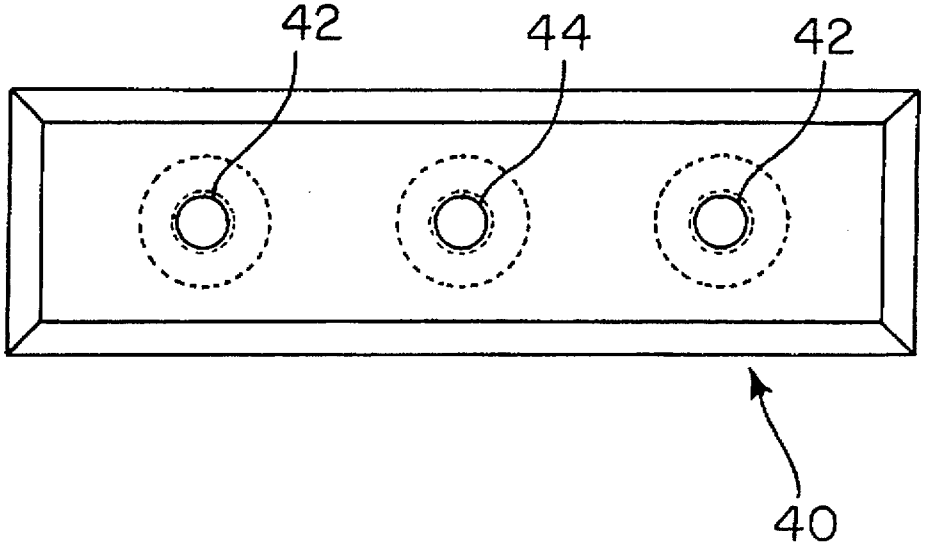
FIG. 5 is a front view of the bar.
Figure 6:
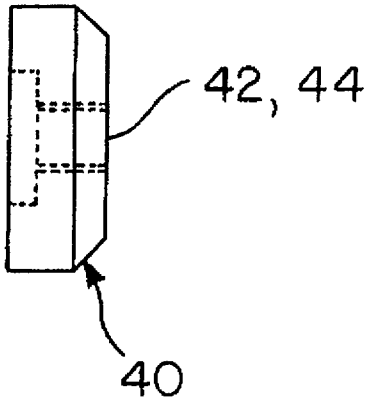
FIG. 6 is an end view of the bar.
Figure 9:
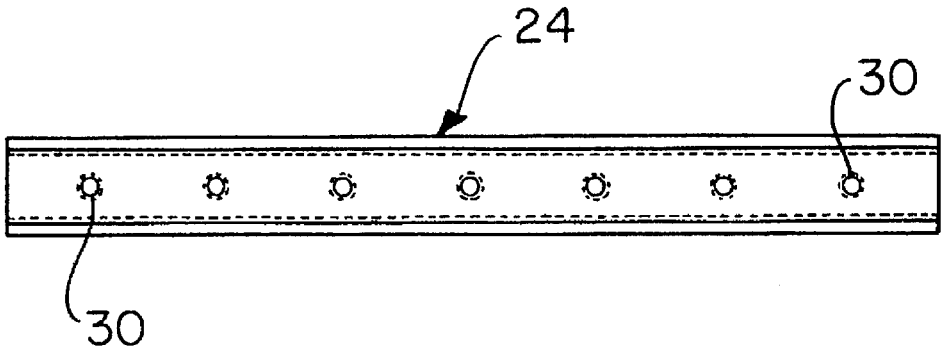
FIG. 9 is a front view of the mounting bar.

As illustrated in FIGS. 3 and 4, depth sensor 10 includes a laser detector window 14 for receiving a laser beam from laser source 12 and an observation window 16 in a position for viewing by the operator of the excavator. An ON/OFF switch 18 is provided which preferably automatically turns the electronics of the depth sensor OFF after, for example, a 20 minute delay. Battery cover 20 is also provided for allowing a battery to be inserted into a battery compartment. An auxiliary cable connector 22 may be provided for connection to an external device.

Depth sensor 10 is conventional and may be constructed and operated as discussed in U.S. Pat. No. 4,884,939. Also, for example, a sensor made by Martronic Engineering, Inc. of Simi Valley , Calif. under Model No. LS180 may be used. Of course, any sensor which accomplishes the disclosed purpose may be used. The depth sensor may include a plurality of photosensitive cells for receiving a laser beam from laser source 12. The operator may view indicia 17 in observation window 16 to determine the depth of the digging bucket. As is also well known, the depth sensor 10 may include inclination sensing means for sensing the inclination of the stick with respect to true vertical so that an accurate indication of the depth may be obtained as is also discussed in U.S. Pat. No. 4,884,939.

In operation, for example, to dig a trench to a desired depth below grade, laser source 12 is set up at a convenient location at a known elevation. The position of depth sensor 10 is adjusted to be at a known distance above the cutting edge of bucket 8. As is discussed in U.S. Pat. No. 4,884,939, the operator digs until the desired depth is estimated as being approached and then extends and positions the stick in a vertical orientation with the cutting edge of the bucket 8 resting on the floor of the trench. The operator may then observe the indicia or indicators 17 in observation window 16 to determine the depth of the trench with respect to the desired depth. This process may be repeated as often as necessary until the depth is the desired depth.

As is illustrated in FIGS. 2–10, depth sensor 10 is magnetically attached to stick 6. A mounting bar 24 includes magnets 26 which are spaced from the mounting bar by rubber spacers 28. Magnets 26 may have a magnetic force of 130 pounds; of course, magnets of any force strong enough to securely hold the sensor on stick 6 may be used. A plurality of threaded holes 30 extend along the length of mounting bar 24.

Figure 10:
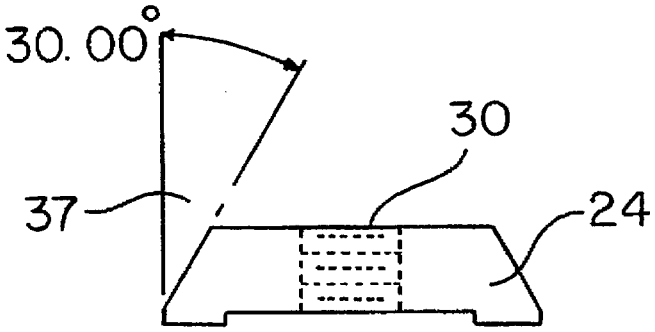
FIG. 10 is an end view of the mounting bar.
Figure 7:
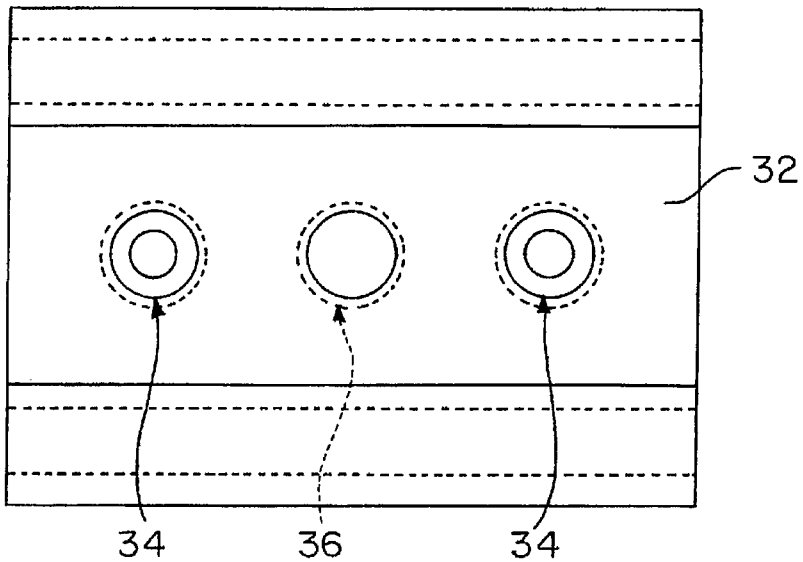
FIG. 7 is a front view of the dovetail assembly.
Figure 8:
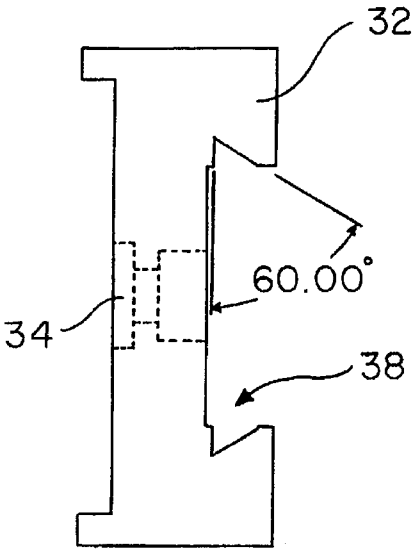
FIG. 8 is an end view of the dovetail assembly.

The dovetail assembly 32 is positioned between the mounting bar 24 and depth sensor 10. The dovetail assembly includes two outer holes 34 and a center hole 36. As is best shown in FIG. 10, the mounting bar is substantially trapezoidally shaped, and includes an angle 37 of, for example, 30 degrees. The dovetail assembly includes a trapezoidal groove 38 having an angle of, for example, 60 degrees, which is complimentary to the shape of the mounting bar, and accordingly, slidably receives the mounting bar therein. Of course, any desired angles and/or complimentary shapes of the mounting bar and groove may be used.

A bar 40 is positioned on the other surface of depth sensor 10 as illustrated in FIG. 3. The bar 40 includes outer holes 42 and center hole 44.

As illustrated in FIGS. 3 and 4, bolts 46 extend through outer holes 34 in dovetail assembly 32 and through holes 47 in the depth sensor 10 and are threaded into outer holes 42 of bar 40. Knob 48 includes a threaded portion 50 which extends through center hole 44, hole 45 in depth sensor 10, center hole 36, and is threaded into a selected threaded hole 30 in mounting bar 24. Therefore, it can be seen that when the dovetail assembly 32 is slidably mounted on mounting bar 24, the depth sensor may be positioned at a plurality of positions depending upon the hole that threaded portion 50 is inserted into. Knob 48 may include a knurled portion 52 to allow the operator to easily turn the knob to reposition depth sensor 10.

Because of the above described arrangement, the depth sensor is easily attached and detached from any excavator, is light in weight, and is lower in cost than other known attachment devices. Furthermore, the stick of the excavator does not have to be modified in order to attach the depth sensor.

Modifications of the invention will be readily apparent to those skilled in the art and it is intended that the scope of the invention be determined solely by the appended claims.

What is claimed:

1. A depth sensor for attachment to a stick of an excavator, said depth sensor comprising:

a receiver for sensing a laser beam;

a mounting device for mounting said receiver to the stick of the excavator; and said mounting device including at least one magnet for attachment to said stick, said mounting device includes a mounting bar attached to said at least one magnet, an assembly being slidably mounted along said mounting bar, said receiver being attached to said assembly;

wherein one side of said receiver is attached to said assembly, and further comprising a bar being mounted on a second side of said receiver, said second side being opposite from said one side of said receiver, said mounting bar including a plurality of holes, a first threaded element extending through said bar, said receiver, said assembly, and into a selected one of said plurality of holes of said mounting bar.

2. The depth sensor according to claim 1, said assembly including a groove which is complimentary in shape to the shape of said mounting bar, said mounting bar being received in said groove.

3. The depth sensor according to claim 2, wherein said groove is substantially trapezoidally shaped.

4. The depth sensor according to claim 1, further comprising at least one second threaded element, said at least one second threaded element extending through said assembly, said receiver, and into said bar.

5. The depth sensor according to claim 1, said first threaded element including a knob.

6. The depth sensor according to claim 1, said mounting device including a plurality of magnets.

7. The depth sensor according to claim 1, said mounting bar having first and second ends, a magnet attached adjacent to each of said first and second ends.

8. A depth sensor for attachment to an excavator, said excavator having at least one movable arm, said depth sensor comprising:

a receiver for sensing a laser beam;

a mounting device for mounting said receiver to a surface of the at least one movable arm; and said mounting device including at least one magnet for attachment to said surface of the at least one movable arm, said mounting device includes a mounting bar attached to said at least one magnet, an assembly being slidably mounted along said mounting bar, said receiver being attached to said assembly;

wherein one side of said receiver is attached to said assembly, and further comprising a bar being mounted on a second side of said receiver, said second side being opposite from said one side of said receiver, said mounting bar including a plurality of holes, a first threaded element extending through said bar, said receiver, said assembly, and into a selected one of said plurality of holes of said mounting bar.

9. The depth sensor according to claim 8, said mounting device including at least two contacting surfaces for contacting said surface of the at least one movable arm, one of said at least two contacting surfaces being spaced from an other of said at least two contacting surfaces.

10. The depth sensor according to claim 9, further comprising a recess between said at least two contacting surfaces.

11. The depth sensor according to claim 10, said receiver including an observation window having indicia, said indicia being arranged parallel with and spaced from said surface of the at least one movable arm.

12. The depth sensor according to claim 9, wherein each of said contacting surfaces includes a magnet.

13. The depth sensor according to claim 8, said mounting device having first and second ends, a magnet attached to each of said first and second ends.

14. A depth sensor for attachment to a stick of an excavator, said depth sensor comprising:

a receiver for sensing a laser beam; and a mounting device for mounting said receiver to the stick of the excavator, said mounting device including at least one magnet for attachment to said stick, said mounting device including a mounting bar attached to said at least one magnet, said mounting bar including a plurality of holes, an assembly being slidably mounted along said mounting bar, one side of said receiver being attached to said assembly, and further comprising a bar being mounted on a second side of said receiver, said second side being opposite from said one side of said receiver, a first threaded element extending through said bar, said receiver, said assembly, and into a selected one of said plurality of holes of said mounting bar.

15. The depth sensor according to claim 14, further comprising at least one second threaded element, said at least one second threaded element extending through said assembly, said receiver, and into said bar.

16. The depth sensor according to claim 14, said first threaded element including a knob.

* * * * *